US005503393A

United States Patent [19]

Casperson

[11] Patent Number: 5,503,393

[45] Date of Patent: Apr. 2, 1996

[54] GOLF PUTTING AID AND METHOD

[76] Inventor: John L. Casperson, 732 S. 6th St., Las Vegas, Nev. 89101

[21] Appl. No.: 333,763

[22] Filed: Nov. 3, 1994

[51] Int. Cl.[6] ..... A63B 57/00

[52] U.S. Cl. ..... 273/32 H

[58] Field of Search ..... 273/32 R, 32 B, 273/32 H; 33/245, 292; 359/399

[56] References Cited

U.S. PATENT DOCUMENTS

| | | | |
|---|---|---|---|
| D. 194,040 | 11/1962 | Schroeder | 273/32 H X |
| 3,293,755 | 12/1966 | Cronwell | 273/32 H X |
| 4,005,870 | 2/1977 | Grace et al. | 273/32 H X |
| 4,258,475 | 3/1981 | Buckley | 273/32 H X |
| 4,260,151 | 4/1981 | Weaver | 273/32 H |
| 4,960,278 | 10/1990 | Hainey | 273/32 B |
| 4,984,791 | 1/1991 | Labell | 273/32 H |
| 5,052,114 | 10/1991 | Levenson et al. | 273/32 H X |
| 5,054,153 | 10/1991 | Silliman | 273/32 B X |

*Primary Examiner*—William H. Grieb
*Attorney, Agent, or Firm*—Roy A. Ekstrand

[57] ABSTRACT

A golf putting aid for use in reading a green slope includes a housing having an interior cavity and a pair of apertures aligned along a common center axis. A pair of lenses are supported proximate each aperture and provide magnification of the field of view presented as the user looks through the golf putting aid. The forwardmost lens supports a vertical crosshair generally aligned with the major vertical axis of the putting aid and a horizontal crosshair displaced beneath the center of the forwardmost lens.

12 Claims, 3 Drawing Sheets

GOLF PUTTING AID AND METHOD

FIELD OF THE INVENTION

This invention relates generally to apparatus for playing the game of golf and particularly to the putting phase of golf play.

BACKGROUND OF THE INVENTION

The sport of golf has enjoyed great popularity for many years in a substantial portion of the world population. The game is popular among participants of all age groups and earnestly pursued by individuals of a variety of skill levels extending from the most accomplished professional to the occasional or weekend golfer with very dubious skills. Golf is played on an expansive course usually scenic and extending for substantial distances. The course of often adorned with attractive natural features, landscapes and manmade objects and is organized in a plurality of segments referred to by golfers as "holes". Typically, golf courses are organized in nine hole groups with each hole being numbered. For many golfers, a substantial part of the appeal of golf as a sport or recreational activity is found in the breadth and scope of the typical golf course. Each hole is formed by a very wide irregularly shaped grass portion referred to as a fairway which is bounded on each side by untended areas referred to as roughs. The shape and length of the fairway is varied to provide challenge to the player. However, most fairways extend for distances between one hundred and fifty and two hundred and seventy five yards. Fairways are often provided with additional obstacles such as small ponds, lakes or streams or manmade sand areas known as sandtraps. At the far end of each fairway, a smaller portion known as a green is provided. Upon the green which is formed of a smooth short cut grass having a carpet-like texture a cup or hole is positioned. The cup or hole is usually fitted with a short staff having a numbered flag extending upwardly from the hole. To increase the challenge of the golf game, greens are seldom flat and are usually sloped or contoured making putting thereon challenging.

Each hole is played by initially driving the ball from tee at one end of the fairway toward the green with the eventual object of putting the ball into the hole or cup. The objective of the golfer is to achieve this in as few strokes as possible.

The golfer's skill is tested through a wide range of distances as the golfer employs clubs known as woods for initial long distance shots or drives toward the green followed by shorter closer shots using clubs referred to as irons as the golfers attempts to place the ball upon the green. Once the ball is on the green, the golfer then utilizes a precise club known as a putting iron or putter to stroke the ball into the cup or hole. For many golfers, the long distance drives and middle distance approach shots are exhilarating and fulfilling while the short distance putting activity is met with substantial frustration.

After having successfully moved the ball two hundred and fifty yards down the fairway and onto the green, players are often frustrated at requiring three or four putts to close the final ten yards or so across the green and into the cup.

One the most frequent causes of golfer's frustration in putting is their lack of ability in an activity known as "reading" the green. The process of reading the green refers to the player's activity in analyzing the slope or contour of the portion of the green which their ball traverses during putting in order to reach the cup. Players read this slope or contour and attempt to make compensating adjustment in the direction in which they aim the put and the speed at which they stroke the ball. For example, a player realizing the green slopes downwardly from right to left as he addresses the cup from behind the ball attempts to compensate by putting the ball upwardly against the slope at an angle which directs the ball to the right of the cup anticipating the curved travel of the ball to the left as it heads for the cup. Unfortunately for most players and particularly those who have limited skill levels or infrequent opportunity to play golf, this reading process is difficult.

There arises therefore a need in the art for a golf putting aid which assists the golfer in reading the green prior to attempting to put and which thereby enhances the player's enjoyment of the game.

SUMMARY OF THE INVENTION

Accordingly, it is a general object of the present invention to provide an improved golf putting aid. It is a more particular object of the present invention to provide an improved golf putting aid which assists the golfer in reading the green and in determining a compensating direction for putting.

In accordance with the present invention, a golf putting aid comprises: a housing defining an interior cavity, a first aperture, a second aperture and a centerline axis therebetween; first and second lenses supported within the interior cavity proximate the first and second apertures aligned with the centerline axis, the first and second lenses cooperating to provide a magnified field of view when an observer looks through the first and second apertures and the first and second lenses; a vertical crosshair supported by the second lens generally centered in the second aperture; and a horizontal crosshair supported by the second lens displaced downwardly from the centerline axis, the vertical and horizontal crosshairs being superimposed upon the magnified field of view.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
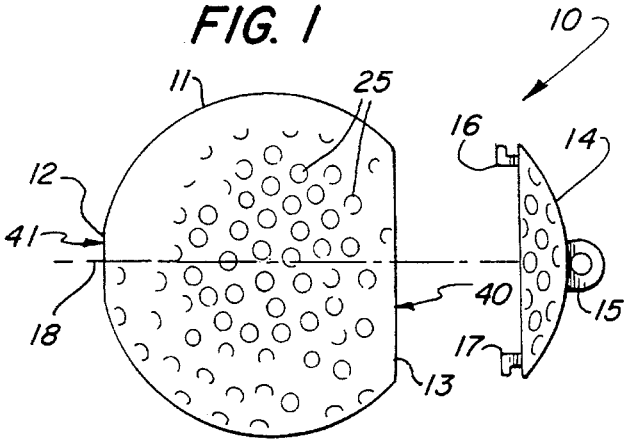
FIG. 1 sets forth a side assembly view of a golf putting aid constructed in accordance with the present invention.

FIG. 1 sets forth a side assembly view of a golf putting aid constructed in accordance with the present invention and generally referenced by numeral 10. Putting aid 10 includes a generally spherical housing 11 defining an eye aperture 12 at one side and a view aperture 13 at the remaining side. Housing 11 is generally spherical and thus defines a centerline axis 18 extending through the centers of eye aperture 12 and view aperture 13 both of which are preferably circular apertures. For purposes of aesthetics, the outer surface of housing 11 defines a plurality of recesses or dimples 25 arranged in a pattern replicating the outer surface of a conventional golf ball. A removable cap 14 is formed of a spherical section and is sized to fit upon and cover view aperture 13. Cap 14 includes a pair of locking tabs 16 and 17 which cooperate with slots 19 and 20 (seen in FIG. 2) to secure cap 14 to housing 11 covering view aperture 13 in a twist lock or bayonet-type removable attachment. As is better seen in FIG. 3, golf putting aid 10 further includes an eye lens 41 supported within housing 11 proximate aperture 12 and a front lens 40 supported within housing 11 proximate aperture 13. Lenses 40 and 41 are preferably centered upon centerline axis 18. As is also better seen in FIG. 3, the remainder of housing 11 is hollow defining an interior cavity 30 extending between lenses 40 and 41.

Figure 4:
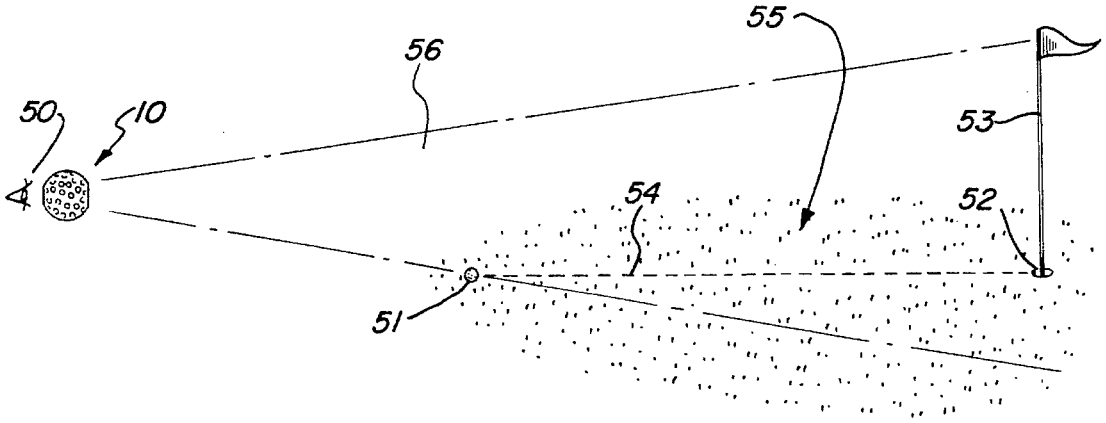
FIG. 4 sets forth a illustrative view of the use of the present invention golf putting aid.

Thus, in accordance with the present invention and as is better seen in FIG. 4, the user is able to grasp putting aid 10 and remove cap 14 to configure putting aid 10 in its operational arrangement. Thereafter, the user is able to look into eye aperture 12 through lenses 41 and 40 and housing 11 and outwardly through view aperture 13. As is described below in greater detail, the user is able to analyze or interpret the contour or slope of a putting green using putting aid 10 in this manner. Suffice it to note here that the user is able to look through putting aid 10 and view a magnified image of a portion of the putting green as a field of view.

Figure 2:
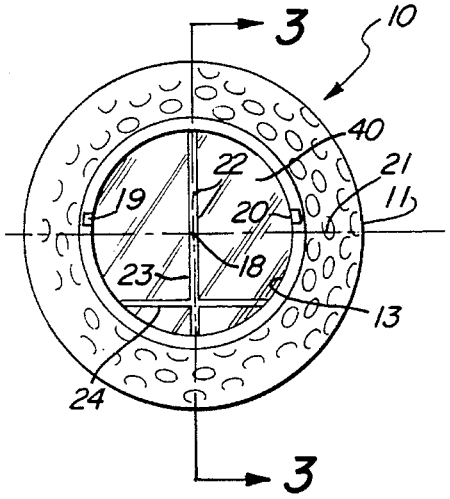
FIG. 2 sets forth a front view of the present invention golf putting aid.

FIG. 2 sets forth a front view of the present invention putting aid showing the spherical outer surface of housing 11 and the circular character of front aperture 13. Also seen in FIG. 2 is a portion of front lens 40 which supports a vertical crosshair 23 and a horizontal crosshair 24. Housing 11 further defines slots 19 and 20 used to secure removable cap 14.

As shown in FIG. 1, golf putting aid 10 defines a centerline axis 18 extending through the center from front to back and between lenses 41 and 40. In addition, FIG. 2 shows a horizontal center axis 21 and a vertical center axis 22 intersecting at centerline axis 18.

In accordance with an important aspect of the present invention, it should be noted that vertical crosshair 23 is aligned with vertical center axis 22 while horizontal crosshair 24 is displaced downwardly by a substantial distance from horizontal center axis 21. This provides substantial advantage in the operation of golf putting aid 10 described below in greater detail.

Figure 3:
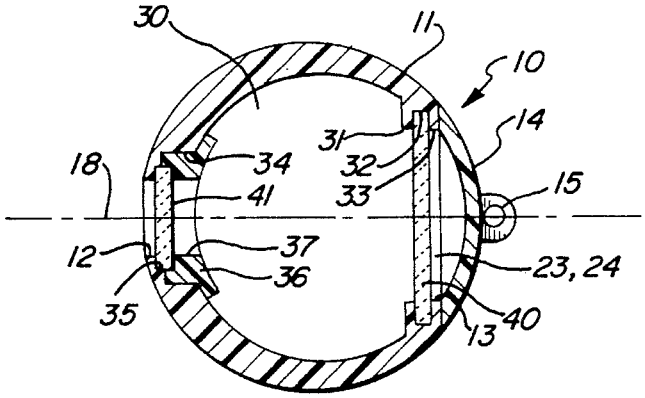
FIG. 3 sets forth a section view of the present invention golf putting aid taken along section lines 3—3 in FIG. 2.

FIG. 3 sets forth a section view of golf putting aid 10 taken along section lines 3—3 in FIG. 2. As described above, golf putting aid 10 includes a generally spherical housing 11 defining an interior cavity 30. Housing 11 further defines an eye aperture 12 and a viewing aperture 13. A pair of spaced apart lips 31 and 33 are formed proximate aperture 13 and define a recessed groove 32 therebetween. A circular front lens 40 is received within groove 32 and captivated by lips 31 and 33. As described above, the frontal surface of lens 40 supports a vertical crosshair 23 and a horizontal crosshair 24. Housing 11 further defines a recess 35 proximate aperture 12 which receives a circular eye lens 41. Housing 11 further defines a larger recess 34 encircling recess 35. A retainer 36 configured to be received within recess 34 and defining an aperture 37 is secured within recess 34 using conventional attachment means such as adhesive bonding or the like to captivate lens 41 against aperture 12. A removable cap 14 is secured to housing 11 covering aperture 13. Cap 14 defines a loop 15 which may be used to secure golf putting aid 10 to a convenient carrying apparatus such as a loop of cord, a keyring or other attachment.

Thus, as will be apparent from FIGS. 1 through 3, the user is able to look into eye aperture 12 through lens 41 and interior cavity 30 and outwardly through lens 40 and viewing aperture 13 of golf putting aid 10 once cap 14 is removed. The selection of front lens 40 and eye lens 41 is to some extent a matter of design choice. The overall objective of lens selection is to provide a significant magnification of the viewed scene as the user looks through golf putting aid 10. For example, it has been found advantageous to utilize a front lens having a plus 6.00 characteristic together with an eye lens having a negative 8.00 characteristic. It will be apparent to those skilled in the art however that other lens characteristics may be utilized without departing from the spirit and scope of the present invention.

Figure 5:
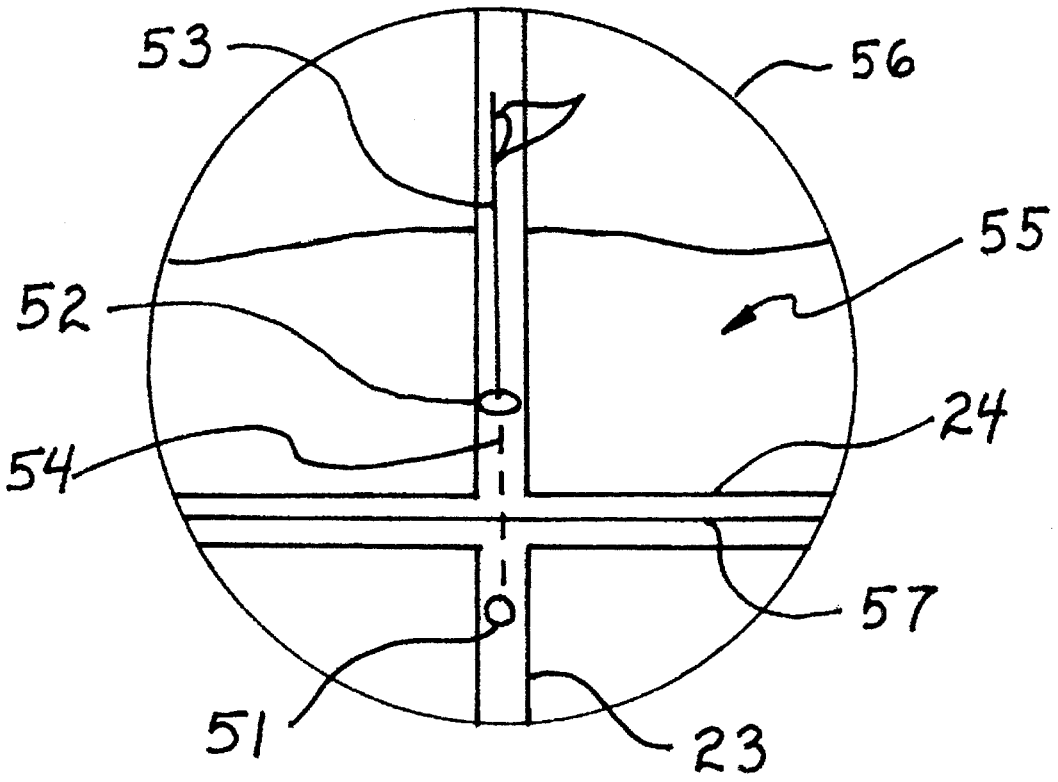
FIG. 5 sets forth an illustrative view of a typical putting green using the present invention golf putting aid.

FIG. 5 illustrates the operative character of the present invention golf putting aid in which the user has encountered a putting green 55 having a hole or cup 52 defined therein. A flag 53 is supported within cup 52 using conventional fabrication techniques. In the illustration of FIG. 4, the user's ball 51 has come to rest upon putting green 55 necessitating the user undertaking a putting stroke in attempting to stroke the ball into cup 52. In the intended use of the present invention golf putting aid, the user assumes a position behind ball 51 and along a straight line 54 extending between cup 52 and ball 51. Thus, the user is then observing both ball 51 and cup 52 along a direction of sight corresponding to straight line 54 therebetween. The user then places golf putting aid 10 in alignment with eye 50 and looking through golf putting aid 10 observes a limited field of view 56 which includes ball 51 and cup 52. FIG. 5 sets forth an example of the limited field of view resulting from the situation in FIG. 4.

Returning to FIG. 4, it will be apparent to those skilled in the art that the process of assuming the correct position along straight line 54 behind ball 51 is readily accomplished by even the most novice of golfers in that it requires a simple straight line alignment of two objects, ball 51 and cup 52. It will be equally apparent that the placement of golf putting aid 10 in front of the user's eye is a simple familiar process. Thus, the present invention golf putting aid requires little in the way of sophistication of the part of the golfer to effectively implement its use.

FIG. 5 sets forth an illustration of a limited field of view 56 as seen through golf putting aid 10 in a situation corresponding to FIG. 4. As can be seen, field of view 56 includes cup 52 and ball 51 aligned with imaginary line 54 upon which the user has assumed position. In accordance with an important aspect of the present invention, horizontal crosshair 24 and vertical crosshair 23 are superimposed upon field of view 56 and may be simultaneously observed as the user looks through the golf putting aid. Thus, the user initially aligns vertical crosshair 23 with the imaginary line 54 extending between ball 51 and cup 52. If the user has assumed the proper position with respect to ball 51 and cup 52, this alignment will place vertical crosshair 23 in a generally vertical orientation. In the example shown in FIG. 5, green 55 defines a generally flat surface and therefore the surface of green 55 exhibits a horizontal slope 57. In this situation, the user observes the fact that the observed green slope such as slope line 57 is generally aligned with horizontal crosshair 24. This tells the user that a straight away put along line 54 will be effective in stroking ball 51 into cup 52. The user then removes putting aid 10 placing it in a convenient holding location and thereafter puts ball 51 straight forwardly toward cup 52.

Figure 6A:
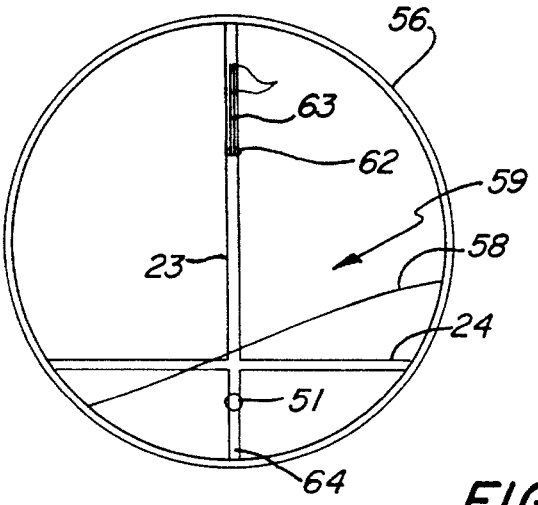
FIGS. 6A through 6C sets forth sequential views illustrating the operation of the present invention golf putting aid.
Figure 6B:
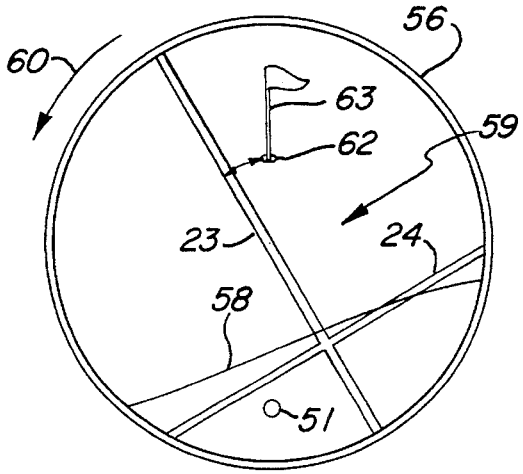
Figure 6C:
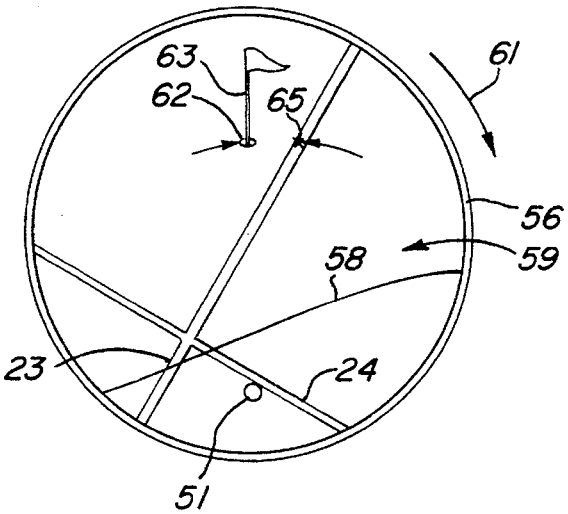

FIGS. 6A through 6C set forth exemplary fields of view showing sequential operation of the present invention golf putting aid when a putting green having a nonhorizontal slope is encountered. FIG. 6A shows field of view 56 observing a putting green 59 having a slope 58. Putting green 59 shows a cup 62 supporting a flag 63. In addition, ball 51 is positioned upon putting green 59. Field of view 56 results from the user assuming a position behind ball 51 and aligned with an imaginary line extending between ball 51 and cup 62 generally referenced by numeral 64. Thus, in position behind ball 51 along imaginary line 64, the field of view 56 is shown in FIG. 6A. In accordance with the above-described process, the user aligns vertical crosshair 23 with imaginary line 64 and observes the concurrence of vertical crosshair 23 with imaginary line 64 as a check upon the user's correct position. As mentioned, putting green 59 is not flat and defines a slope 58 in the intervening portion between ball 51 and cup 62. The user observes that slope 58 departs substantially from horizontal crosshair 24 and thus realizes that a correction in putting direction will be required to compensate for slope 58.

FIG. 6B sets forth the orientation of putting aid 10 by the user in the first step of determining the correction required to compensate for slope 58. As can be observed, field of view 56 in FIG. 6B results from the user's rotation of the golf putting aid in the direction indicated by arrow 60 until horizontal crosshair 24 is generally aligned with slope 58. The rotation of the golf putting aid which aligns horizontal crosshair 24 with slope 58 also causes an angular change of position for vertical crosshair 23. The user then observes the distance or displacement of the adjacent portion of vertical crosshair 23 shown as distance 67. This distance corresponds to the magnitude of directional correction which will be required on the ensuing put.

FIG. 6C sets forth field of view 56 as the user undertakes the final step in utilizing the present invention golf putting aid. Following the correction distance observed in FIG. 6B, the user then rotates the golf putting aid in the direction indicated by arrow 61 until vertical crosshair 23 is positioned on the opposite side of cup 62 by a distance corresponding to corrective distance 67 in FIG. 6B. It has been found that most, if not all, golfers can readily make this estimate of opposite side distance. If needed, the user may return to the position of FIG. 6B by rotating the golf putting aid again to align horizontal crosshair 24 with slope 58 and refresh the user's memory as to distance 67. In any event, once the user has positioned vertical axis 23 in a mirror image position to that of FIG. 6B, the user then marks an imaginary point 65 in his or her mind. This imaginary point then becomes the target of the user on the ensuing put as the user puts toward imaginary point 65 allowing slope 58 to curve the putted ball into cup 62.

It will be apparent to those skilled in the art that with a small amount of practice virtually any golfer will be able to achieve substantial improvement in their ability to read and analyze the putting green slope to achieve improved proficiency and enjoyment of the game.

Figure 7:
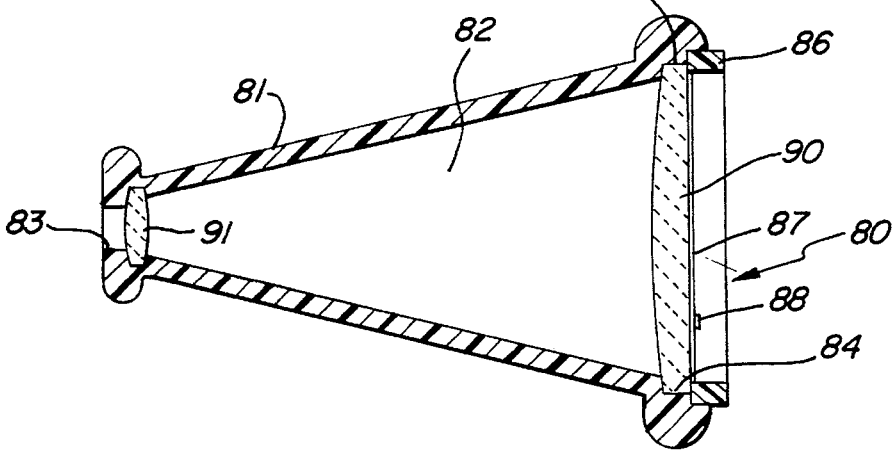
FIG. 7 sets forth a section view of an alternate embodiment of the present invention golf putting aid.

FIG. 7 sets forth a section view of an alternate embodiment of the present invention golf putting aid having a generally conical shape and generally referenced by numeral 80. Golf putting aid 80 operates in the same manner as described above for golf putting aid 10 with the major difference being the use of a cone-shaped housing 81. Housing 81 defines an interior cavity 82, an eye aperture 83 and a view aperture 84. An eye lens 91 is supported within housing 81 proximate eye aperture 83 while a front lens 90 is supported within a recess 85 formed proximate view aperture 84. An annular retaining ring 86 is received within and secured to the frontal portion of housing 81 and captivates front lens 90 within recess 85 using conventional adhesive bonding or other attachment. Front lens 90 supports a vertical crosshair 87 and a horizontal crosshair 88 positioned in the same manner as crosshairs 23 and 24 are positioned upon front lens 40 of golf putting aid 10 shown in FIGS. 1 through 3.

The operation of golf putting aid 80 is identical to that described above for golf putting aid 10.

What has been shown is a golf putting aid which is easy to carry and use and which facilitates improved play by even the most novice or infrequent golfer. The golf putting aid is simple to operate and permits the golfer to immediately analyze the slope of a green and to determine a correcting direction for the ensuing put. The golf putting aid shown may be conveniently carried or stored in a typical golf bag or, alternatively, may be carried on keychain or neck cord without significant inconvenience. The entire apparatus may be formed of a molded plastic material facilitating a low cost of manufacture and providing a waterproof character. It will be apparent to those skilled in the art that while a spherical and conical embodiment of the present invention are shown, the present invention may be configured in a variety of exterior shapes without departing from the spirit and scope of the present invention.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A golf putting aid comprising:

a housing defining an interior cavity, a first aperture, a second aperture and a centerline axis therebetween;

first and second lenses supported within said interior cavity proximate said first and second apertures aligned with said centerline axis, said first and second lenses cooperating to provide a magnified field of view when an observer looks through said first and second apertures and said first and second lenses;

a vertical crosshair supported by said second lens generally centered in said second aperture; and a horizontal crosshair supported by said second lens displaced downwardly from said centerline axis, said vertical and horizontal crosshairs being superimposed upon said magnified field of view.

2. A golf putting aid as set forth in claim 1 wherein said housing is generally spherical.

3. A golf putting aid as set forth in claim 2 wherein said housing defines an outer surface having a plurality of circular recesses formed to resemble the surface of a golf ball.

4. A golf putting aid as set forth in claim 3 wherein said first aperture is substantially smaller than said second aperture.

5. A golf putting aid as set forth in claim 4 wherein said housing further includes:

a cap forming a spherical segment sufficient in size to cover said second aperture; and means for removably attaching said cap to said housing to cover said second aperture.

6. A golf putting aid as set forth in claim 5 wherein said second lens defines an outer surface and wherein said vertical and horizontal crosshairs are supported upon said outer surface.

7. A golf putting aid as set forth in claim 2 wherein said first and second apertures are generally circular.

8. A golf putting aid as set forth in claim 1 wherein said first aperture is substantially smaller than said second aperture.

9. A golf putting aid as set forth in claim 1 wherein said housing is generally conical having a larger end and a smaller end.

10. A golf putting aid as set forth in claim 9 wherein said first aperture is formed at said smaller end and said second aperture is formed at said larger end.

11. A method of reading a golf green defining a slope comprising the steps of:

providing a magnified field of view of a ball and a golf cup with an intervening imaginary straight line therebetween;

providing a vertical crosshair superimposed upon said field of view through the approximate center thereof and a horizontal crosshair superimposed upon said field of view positioned below the center thereof;

aligning said vertical crosshair with said ball and said cup;

observing the relationship between said horizontal crosshair and said golf green slope;

first rotating said vertical and horizontal crosshairs to align said horizontal crosshair with said golf green slope;

noting the distance between said cup and the adjacent portion of said vertical crosshair; and directing a put in a direction offset from said cup by a margin corresponding to said noted distance.

12. The method of claim 11 further including the steps of:

second rotating said vertical and horizontal crosshairs to position said vertical crosshair at a mirror image position to that observed in said first rotating step;

fixing an imaginary point upon said green corresponding to said distance in said noting step; and using said imaginary point as a target in said directing step.

* * * * *